US006796858B2

(12) United States Patent
Dusablon et al.

(10) Patent No.: US 6,796,858 B2
(45) Date of Patent: Sep. 28, 2004

(54) STATOR VANE AND IMPELLER-DRIVE SHAFT ARRANGEMENTS AND PERSONAL WATERCRAFT EMPLOYING THE SAME

(75) Inventors: Patrice Dusablon, Palm Bay, FL (US); Gilles Pesant, Palm Bay, FL (US)

(73) Assignee: Bombardier Recreational Products Inc., Saint-Bruno (CA)

( * ) Notice: Subject to any disclaimer, the term of this patent is extended or adjusted under 35 U.S.C. 154(b) by 0 days.

(21) Appl. No.: 10/412,274

(22) Filed: Apr. 14, 2003

(65) Prior Publication Data

US 2003/0194925 A1 Oct. 16, 2003

Related U.S. Application Data

(60) Provisional application No. 60/371,726, filed on Apr. 12, 2002.

(51) Int. Cl.[7] ..... B63H 11/00
(52) U.S. Cl. ..... 440/38; 440/83; 415/199.4
(58) Field of Search ..... 440/38, 83, 52; 415/72, 199.3, 199.4, 199.5; 416/244 B, 245 A; 60/220, 221

(56) References Cited

U.S. PATENT DOCUMENTS

| | | | | | |
|---|---|---|---|---|---|
| 3,014,430 | A | * | 12/1961 | Schneider | 416/180 |
| 3,572,034 | A | * | 3/1971 | Fisher | 60/341 |
| 4,182,118 | A | * | 1/1980 | Chronic | 60/221 |
| 4,993,977 | A | * | 2/1991 | Rodler, Jr. | 440/67 |
| 5,277,631 | A | | 1/1994 | Henmi | 440/47 |
| 5,421,753 | A | * | 6/1995 | Roos | 440/43 |
| 5,451,143 | A | * | 9/1995 | Lin | 416/244 B |
| 5,562,405 | A | * | 10/1996 | Ryall | 415/72 |
| 5,713,769 | A | * | 2/1998 | Jones | 440/38 |
| 5,720,635 | A | * | 2/1998 | Roos | 440/38 |
| 5,755,554 | A | * | 5/1998 | Ryall | 415/199.4 |
| 5,759,074 | A | * | 6/1998 | Jones | 440/38 |
| 5,871,381 | A | | 2/1999 | Lin | 440/38 |
| 5,876,257 | A | | 3/1999 | Lin | 440/38 |
| 6,024,615 | A | * | 2/2000 | Eichinger | 440/52 |
| 6,234,852 | B1 | * | 5/2001 | Kato | 440/38 |

* cited by examiner

*Primary Examiner*—S. Joseph Morano
*Assistant Examiner*—Lars Olson
(74) *Attorney, Agent, or Firm*—BRP Legal Services

(57) ABSTRACT

The invention is directed to a thick stator vane that effects continuous acceleration of the water stream within the jet pump, a non-uniform spacing of stator vanes or impeller blades to reduce noise output of the jet pump during operation, and a coupling structure positioned between the impeller and engine that prevents transfer of axial thrust to the engine caused by jet pump failure.

5 Claims, 17 Drawing Sheets

STATOR VANE AND IMPELLER-DRIVE SHAFT ARRANGEMENTS AND PERSONAL WATERCRAFT EMPLOYING THE SAME

This application relies for priority on U.S. Provisional Patent Application Serial No. 60/371,726, filed on Apr. 12, 2002, entitled "Stator Vane and Impeller-Drive Shaft Arrangements and Personal Watercraft Employing Same" The contents of that provisional patent application are incorporated herein by reference.

BACKGROUND OF THE INVENTION

1. Field of the Invention

This invention relates to jet powered watercraft, especially personal watercraft ("PWC"). More specifically, the invention relates to a jet power assembly, in particular to an impeller and its associated components.

2. Description of Related Art

Jet powered watercraft have become very popular in recent years for recreational use and for use as transportation in coastal communities. The jet power offers high performance and allows the watercraft to be more compact and fast. Accordingly, PWCs, which typically employ jet propulsion, have become common place, especially in resort areas.

A typical jet propulsion system for a PWC includes a jet pump. The jet pump pulls water in through an inlet, pressurizes it, and forces it through a venturi resulting in a high pressure water jet. The result is a reaction force called thrust that propels the PWC in the direction opposite to the water jet. Typically, a steering nozzle, located at the discharge end of the pump, is controlled by a steering mechanism to redirect the water jet so as to effect steering of the PWC. The jet pump utilizes an impeller, rotated by an engine via a drive shaft (and/or impeller shaft) to circulate and pressurize the water. However, the typical impeller utilizes impeller blades that have a relatively large pitch. Accordingly, as the impeller is rotated, the water stream exiting the impeller is directed into a relatively tight spiraling flow. In order to rectify or straighten the spiraling water stream, the typical jet pump includes a non-rotating stator having blades to attenuate or eliminate the rotation of the flow.

FIG. 14 shows a conventional jet pump, which can be used in a jet-propelled watercraft, indicated at 800. The jet pump 800 includes a rigid housing 802 within which a stator 804 is fixedly mounted. An impeller 806 is rotatably mounted to the stator 804 via an impeller shaft 808. As shown, the impeller 806 includes a plurality of impeller blades 810. The stator 804 includes a plurality of stator vanes 812. A pump cover 814 is fastened to a rearward end of the stator 804 with, e.g., fasteners 816. A venturi 818 is connected to the housing 802 rearward of the stator 804. The connecting element 808 is fixedly connected to the impeller 806 and rotates with the impeller 806 relative to the stator 804 on bearings 820. The bearings 820 are disposed within a cavity 822 within the stator 804, which is typically filled with a lubricant. A seal 824 prevents debris and water from entering the cavity 822. The pump cover 814 protects the impeller shaft 808 and bearings 820 and encloses the cavity 822 to prevent lubricant leakage. The pump cover 814 is conically configured to facilitate the flow of water through the venturi 818. The venturi 818 sometimes includes a plurality of fins 826 therein that extend radially inwardly therefrom.

In operation, an engine is coupled to the impeller 806 via a drive shaft (not show) to thereby rotate the impeller 806.

The impeller 806 thus pulls water from the body of water and pressurizes the water as the impeller 806 is rotated. Due to the rotational speed of the impeller 806 and to the pitch of the blades 810, water being pressurized by the impeller 806 assumes a spiraling flow as it exits the impeller 806. The stator vanes 812 extend relatively co-extensively to the axial direction of the jet pump 800 and serve to straighten or rectify the spiraling flow of water as it passes therethrough. The flow of water is accelerated in a progressive manner as the flow travels axially past the impeller 806 due to the progressive increase in diameter of the impeller hub 811. The flow of water exits the stator 804 and enters the venturi 818. A gradual reduction in diameter of the venturi 818 serves to converge the flow of water and also accelerates the flow. The venturi 818 includes an outlet opening 828 through which the flow of water exits the jet pump 800 to propel the watercraft.

FIG. 15 shows the stator 804 in relatively greater detail. As shown, each of the stator vanes 812 is curved to facilitate rectification of the flow of water from the impeller 806. Additionally, each of the vanes 812 has a cross-sectional configuration similar to that of an airfoil with a trailing edge that is slightly tapered. The airfoil-like configuration serves to facilitate flow of water past the stator vanes 812. However, the stator vanes 812 have a relatively constant thickness, typically about 2–5 mm. Since the stator vanes 812 are angled at their leading edge and progressively straighten out toward their trailing edge, and a flow area between the blades at the trailing edge portions is greater than a flow area between the blades at the leading edge portions, the flow of water decelerates as it moves past the vanes 812. The venturi 818 and pump cover 814 are tapered in their cross-sectional configurations so as to converge and pressurize the water stream and, therefore, the water stream is accelerated as it flows past. However, the deceleration of the water flow through the stator 804 represents an energy loss that decreases the efficiency of the jet pump 800.

FIG. 16 shows an improved type of jet pump 850, which is referred to as a converging type jet pump. As shown, the jet pump 850 has a housing 852 that incorporates an integral venturi 854. The jet pump 850 includes a stator 856 that has a plurality of stator vanes 858. A hub 860 of the stator 856 has a conical configuration corresponding to that of the venturi 854. The stator vanes 858 have an airfoil-like configuration similar to those shown in FIG. 15, but may be arranged with a greater degree of curvature. Additionally, the stator vanes 858 are also tapered (radially with respect to the stator hub 860) to conform to the venturi 854. Contrary to the stator 804 shown in FIG. 15, head loss through the stator 856 is reduced, since the cross-sectional area of the flow path between the stator vanes 858 is decreased due to the tapered configuration of the venturi 854 along the length of the vanes 858, even though trailing edge portions of the vanes 858 are narrower than the leading edge portions thereof. This design effectively eliminates the degrading head loss within the stator 856. However, typical manufacturing processes for producing stators, i.e., casting, may not be used or is highly costly due to the conical shape of the hub 860 and configuration of the vanes 858. Therefore, other more costly and inefficient methods of manufacture must be used to create the stator 856.

For at least these reasons, a need has developed for a jet pump that is highly efficient and is easily manufactured.

Another consideration with operation of PWCs is the creation of noise pollution during the operation thereof. The use of internal combustion engines operating at high RPMs make conventional watercraft typically quite noisy to operate. Technological advances in engine noise attenuation systems have dramatically decreased the operating volume of the engine in typical PWCs. Accordingly, now, noise from the jet pump of the jet propulsion system is a greater concern. In particular, an impeller of the jet pump is rotated at a relatively high RPM to generate sufficient power for the PWC. The interaction of the spatially non-uniform velocity distribution at the impeller discharge with the stator vanes of the stator causes lift and drag fluctuations on the stator vanes and flow fluctuations within the stator vane passages. In addition, the periodic blockage of the flow in the impeller blade passages by the stator vanes will result in similar force fluctuations on the impeller blades and also in flow pulsations within the blade passages. Fluctuating forces may be transmitted directly through the fluid or through the vibrational response of the structure (lift fluctuations causing a net axial force component exciting the hub at the pump attachment location). Rotor-stator interaction noise is often called "interaction tones" and can represent a relatively substantial level of noise. This is especially true when the relative rotational speed of the impeller and the stator reaches a critical frequency, wherein multiple fluctuating forces are simultaneously produced by multiple impeller blades simultaneously passing respective stator vanes.

Conventional designs of stators, e.g., stator 804 shown in FIG. 17, have oriented the stator vanes 812 at equal distances apart from one another, e.g., 10 vanes at 36° apart. Accordingly, as illustrated in FIG. 18, at a critical frequency (cf), based on the relative numbers and speeds of the impeller blades and stator vanes, the volume level (dB) of the jet pump reaches a maximum ($dB_{max}$). There are also noise level spikes (dBh1–dBh4) at the subsequent harmonic frequencies (cfh1–cfh4) of the critical frequency.

There is therefore a need in the art to provide a jet pump that operates at lower noise levels, or that at least reduces the critical frequencies, since the noise generated at these frequencies is more irritating to the human ear.

Furthermore, another concern in operating a PWC is to prevent engine failure due to pump failure. When a jet pump fails during operation of the PWC, the pump bearings often get damaged due to the loads and high rotational speed and can no longer take up the axial thrust generated by the impeller, which is then transferred to the engine via the drive shaft connected to the impeller. The transfer of a significant axial load to the engine by the drive shaft is undesirable.

There is thus a need to prevent the transfer of the axial thrust caused by jet pump failure to the engine.

SUMMARY OF THE INVENTION

One aspect of the invention is directed to a jet pump for a watercraft comprising a generally cylindrical housing, an impeller having a hub, a plurality of impeller blades mounted on the hub, and a shaft extending from the hub for connection to a rotatable drive shaft. The impeller is disposed within the housing so as to rotate within the housing when driven by the rotatable drive shaft. A stator has a plurality of vane structures extending generally radially outwardly therefrom and extending axially therealong. The impeller is rotationally connected to the stator to allow relative movement therebetween. A coupling structure is coupled to the shaft, wherein the coupling structure has an elongated configuration including a socket having a mouth configured to receive the drive shaft and a bore disposed on an opposite side of the socket than the mouth so as to allow relative axial movement between the impeller and the drive shaft.

In accordance with another aspect, the invention is directed to a jet pump for a watercraft comprising a generally cylindrical housing having a forward portion and a rearward portion thereof, an impeller having a plurality of impeller blades mounted thereon, the impeller being disposed within the forward portion of the housing and being configured to be connected to a rotatable shaft so as to be rotatable within the housing, and a stator fixedly mounted within the housing adjacent to and rearward of the impeller. The stator has a plurality of circumferentially spaced first vane structures extending generally radially outwardly therefrom, extending axially along the stator, and tapered in width axially toward the impeller. A pump cover is fixedly mounted to a rearward side of the stator and has a plurality of circumferentially spaced second vane structures extending generally radially outwardly therefrom, extending axially along the pump cover, and tapered in width opposite the first vane structures. Each of the plurality of first vane structures abuts a respective one of the plurality of second vane structures. The pluralities of abutting first and second vane structures define a plurality of stator vanes extending axially along the stator and the pump cover and being positioned rearward of said impeller.

In accordance with another aspect, the invention is directed to a jet pump for a watercraft comprising a generally cylindrical housing having a forward portion and a rearward portion thereof and an impeller having a plurality of impeller blades mounted thereon. The impeller is disposed within the forward portion of the housing and is configured to be connected to a rotatable shaft so as to be rotatable within the housing. A stator is fixedly mounted within the housing adjacent to and rearward of the impeller. The impeller is configured to be rotationally coupled to the stator to allow relative rotational movement therebetween. The stator has a plurality of circumferentially spaced vanes extending generally radially outwardly therefrom and extending axially along the stator. Each of the vanes has a thickened intermediate section disposed between a pair of opposed ends that taper from the thickened intermediate section.

A further aspect of the invention is directed to a stator for use in a jet pump having an impeller rotatably coupled with respect to the stator, comprising a central hub portion, and a plurality of stator vanes extending outward from the central hub portion arranged with irregular spacing between adjacent vanes. At least one stator vane is spaced from an adjacent stator vane a different distance than that stator vane is spaced from its other adjacent stator vane.

An additional aspect of the invention is directed to an impeller for use in a jet pump having a stator fixed with respect to the impeller, comprising a central hub portion connected to a drive assembly to rotate the central hub portion, and a plurality of impeller blades extending outward from the central hub portion arranged with irregular spacing between adjacent blades. At least one impeller blade is spaced from an adjacent impeller blade a different distance than that impeller blade is spaced from its other adjacent impeller blade.

The jet pump in accordance with all of the embodiments of the present invention is preferably used in combination with a watercraft.

Preferably, the watercraft is a personal watercraft (PWC). The PWC can be a straddle type seated PWC or a stand-up PWC. Additionally, the watercraft could be different types of jet powered watercraft, such as a jet boat. The invention is directed to a jet pump, however, and is not intended to be limited to a watercraft.

These and other aspects of this invention will become apparent upon reading the following disclosure in accordance with the Figures.

BRIEF DESCRIPTION OF THE DRAWINGS

An understanding of the various embodiments of the invention may be gained by virtue of the following figures, of which like elements in various figures will have common reference numbers, and wherein.

DETAILED DESCRIPTION OF PREFERRED EMBODIMENTS

The invention is described with reference to a PWC for purposes of illustration only. However, it is to be understood that the jet propulsion assembly described herein can be utilized in any watercraft, such as sport boats. Moreover, the watercraft details described herein are not intended to limit the invention, but rather to provide background for one possible implementation of the invention.

The general construction of a personal watercraft 10 in accordance with a preferred embodiment of this invention is shown in FIGS. 1–5. The following description relates to one way of constructing a personal watercraft according to a preferred design. Obviously, those of ordinary skill in the watercraft art will recognize that there are other known ways of manufacturing and designing watercraft and that this invention would encompass other known ways and designs.

Figure 1:
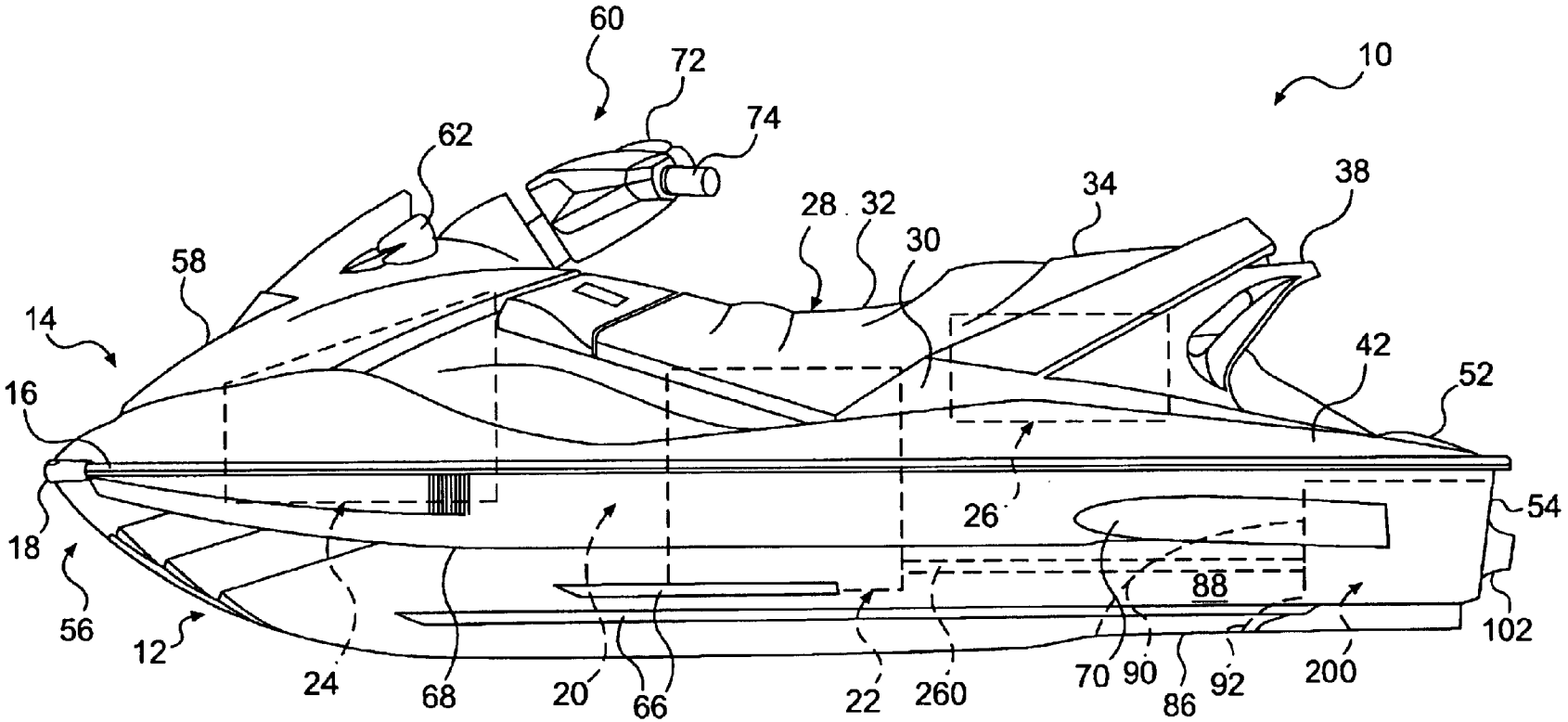
FIG. 1 illustrates a side view of a watercraft in accordance with preferred embodiments of the invention.

The watercraft 10 of FIG. 1 is made of two main parts, including a hull 12 and a deck 14. The hull 12 buoyantly supports the watercraft 10 in the water. The deck 14 is designed to accommodate a rider and, in some watercraft, one or more passengers. The hull 12 and deck 14 are joined together at a seam 16 that joins the parts in a sealing relationship. Preferably, the seam 16 comprises a bond line formed by an adhesive. Of course, other known joining methods could be used to sealingly engage the parts together, including but not limited to thermal fusion, molding or fasteners such as rivets or screws. A bumper 18 generally covers the seam 16, which helps to prevent damage to the outer surface of the watercraft 10 when the watercraft 10 is docked, for example. The bumper 18 can extend around the bow, as shown, or around any portion or all of the seam 16.

The space between the hull 12 and the deck 14 forms a volume commonly referred to as the engine compartment 20 (shown in phantom). Shown schematically in FIG. 1, the engine compartment 20 accommodates an engine 22, as well as a muffler, tuning pipe, gas tank, electrical system (battery, electronic control unit, etc.), air box, storage bins 24, 26, and other elements required or desirable in the watercraft 10. One of the challenges of designing the watercraft 10 is to fit all of these elements into the relatively small volume of the engine compartment 20.

Figure 2:
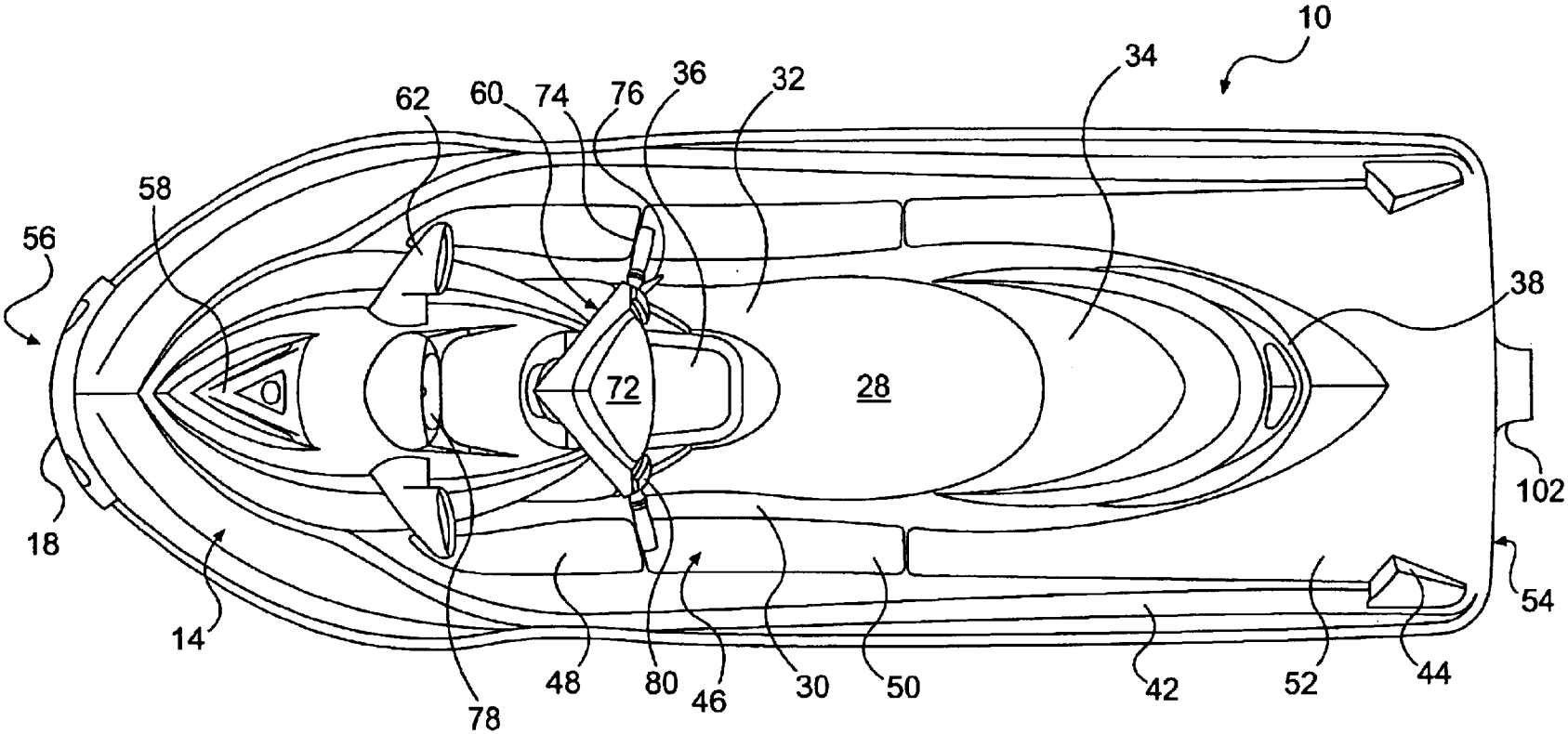
FIG. 2 is a top view of the watercraft of FIG. 1.

As seen in FIGS. 1 and 2, the deck 14 has a centrally positioned straddle-type seat 28 positioned on top of a pedestal 30 to accommodate a rider in a straddling position. The seat 28 may be sized to accommodate a single rider or sized for multiple riders. For example, as seen in FIG. 2, the seat 28 includes a first, front seat portion 32 and a rear, raised seat portion 34 that accommodates a passenger. The seat 28 is preferably made as a cushioned or padded unit or interfitting units. The first and second seat portions 32, 34 are preferably removably attached to the pedestal 30 by a hook and tongue assembly (not shown) at the front of each seat and by a latch assembly (not shown) at the rear of each seat, or by any other known attachment mechanism. The seat portions 32, 34 can be individually tilted or removed completely. One of the seat portions 32, 34 covers an engine access opening (in this case above engine 22) defined by a top portion of the pedestal 30 to provide access to the engine 22 (FIG. 1). The other seat portion (in this case portion 34) can cover a removable storage box 26 (FIG. 1). A "glove compartment" or small storage box 36 may also be provided in front of the seat 28.

Figure 4:
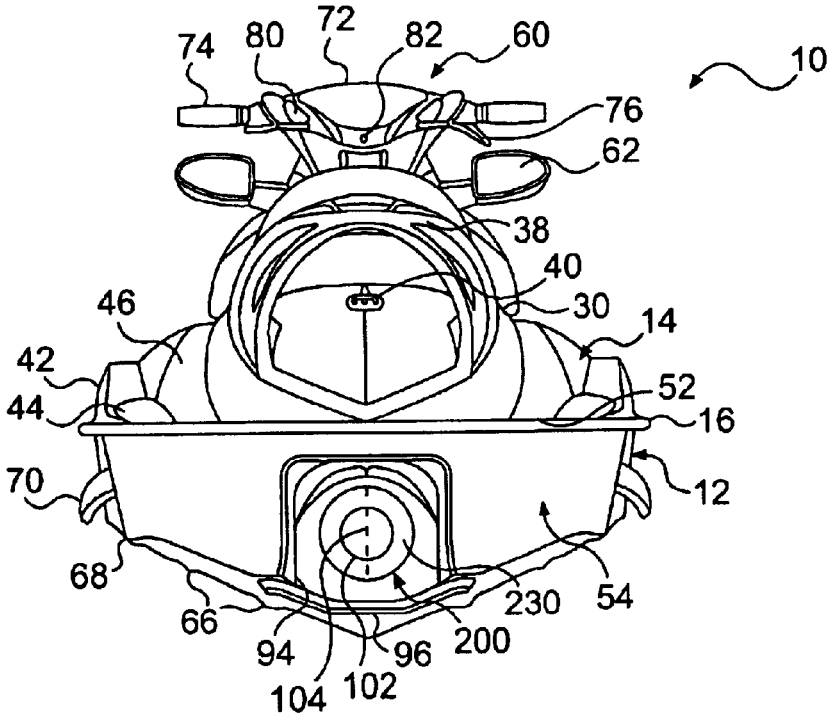
FIG. 4 is a back view of the watercraft of FIG. 1.

As seen in FIG. 4, a grab handle 38 may be provided between the pedestal 30 and the rear of the seat 28 to provide a handle onto which a passenger may hold. This arrangement is particularly convenient for a passenger seated facing backwards for spotting a water skier, for example. Beneath the handle 38, a tow hook 40 is mounted on the pedestal 30.

The tow hook 40 can be used for towing a skier or floatation device, such as an inflatable water toy.

As best seen in FIGS. 2 and 4 the watercraft 10 has a pair of generally upwardly extending walls located on either side of the watercraft 10 known as gunwales or gunnels 42. The gunnels 42 help to prevent the entry of water in the footrests 46, provide lateral support for the rider's feet, and also provide buoyancy when turning the watercraft 10, since personal watercraft roll slightly when turning. Towards the rear of the watercraft 10, the gunnels 42 extend inwardly to act as heel rests 44. Heel rests 44 allow a passenger riding the watercraft 10 facing towards the rear, to spot a water-skier for example, to place his or her heels on the heel rests 44, thereby providing a more stable riding position. Heel rests 44 could also be formed separate from the gunnels 42.

Located on both sides of the watercraft 10, between the pedestal 30 and the gunnels 42 are the footrests 46. The footrests 46 are designed to accommodate a rider's feet in various riding positions. To this effect, the footrests 46 each have a forward portion 48 angled such that the front portion of the forward portion 48 (toward the bow of the watercraft 10) is higher, relative to a horizontal reference point, than the rear portion of the forward portion 48. The remaining portions of the footrests 46 are generally horizontal. Of course, any contour conducive to a comfortable rest for the rider could be used. The footrests 46 may be covered by carpeting 50 made of a rubber-type material, for example, to provide additional comfort and traction for the feet of the rider.

A reboarding platform 52 is provided at the rear of the watercraft 10 on the deck 14 to allow the rider or a passenger to easily reboard the watercraft 10 from the water. Carpeting or some other suitable covering may cover the reboarding platform 52. A retractable ladder (not shown) may be affixed to the transom 54 to facilitate boarding the watercraft 10 from the water onto the reboarding platform 52.

Figure 3:
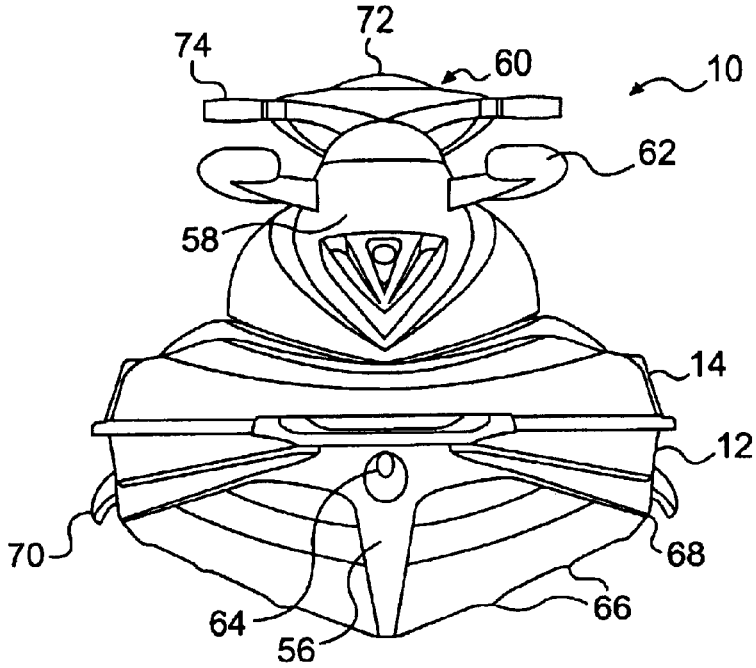
FIG. 3 is a front view of the watercraft of FIG. 1.

Referring to the bow 56 of the watercraft 10, as seen in FIGS. 2 and 3, watercraft 10 is provided with a hood 58 located forwardly of the seat 28 and a helm assembly 60. A hinge (not shown) is attached between a forward portion of the hood 58 and the deck 14 to allow hood 58 to move to an open position to provide access to the front storage bin 24 (FIG. 1). A latch (not shown) located at a rearward portion of hood 58 locks hood 58 into a closed position. When in the closed position, hood 58 prevents water from entering front storage bin 24. Rearview mirrors 62 are positioned on either side of hood 58 to allow the rider to see behind. A hook 64 is located at the bow 56 of the watercraft 10. The hook 64 is used to attach the watercraft 10 to a dock when the watercraft is not in use or to attach to a winch when loading the watercraft on a trailer, for instance.

Figure 5:
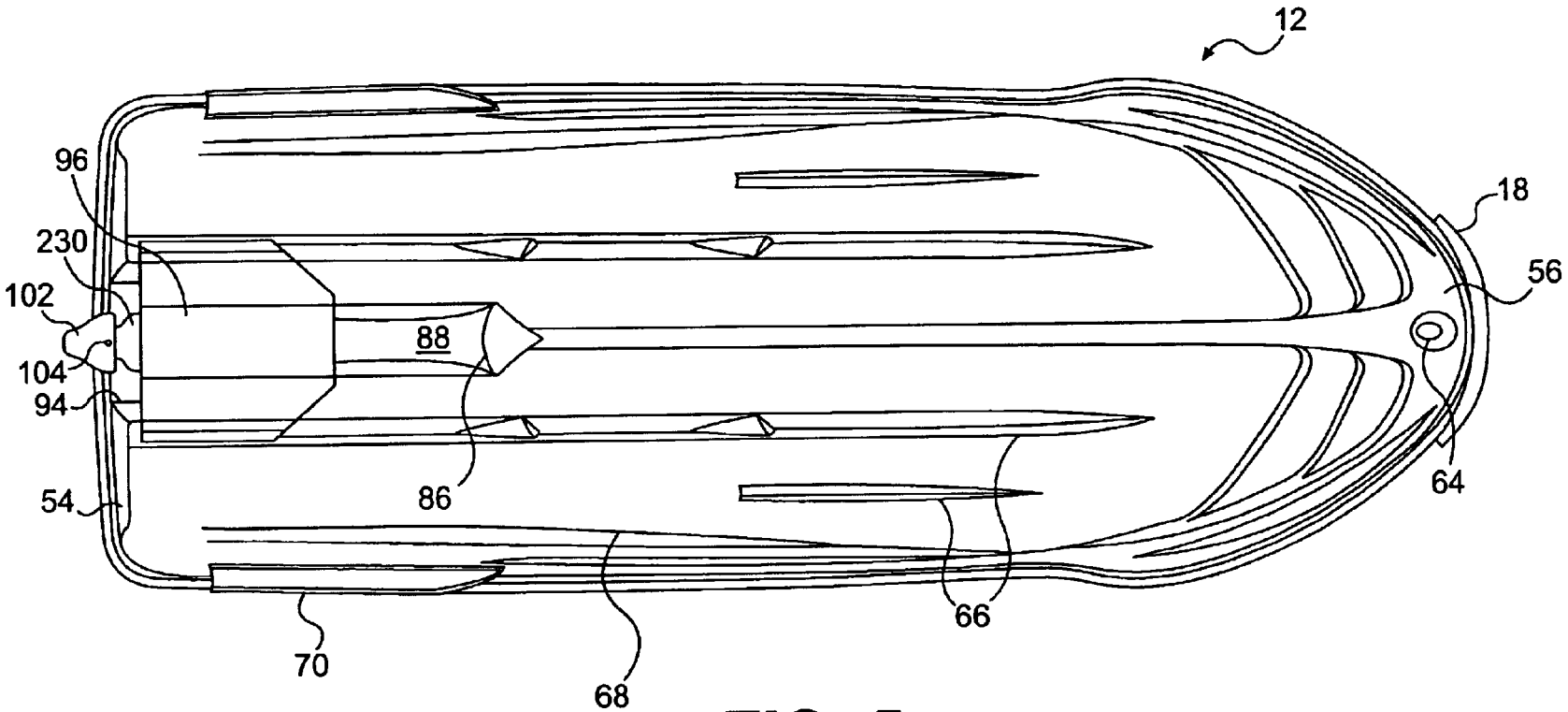
FIG. 5 is a bottom view of the hull of the watercraft of FIG. 1.

As best seen in FIGS. 3, 4, and 5, the hull 12 is provided with a combination of strakes 66 and chines 68. A strake 66 is a protruding portion of the hull 12. A chine 68 is the vertex formed where two surfaces of the hull 12 meet. The combination of strakes 66 and chines 68 provide the watercraft 10 with its riding and handling characteristics. Sponsons 70 are located on both sides of the hull 12 near the transom 54. The sponsons 70 preferably have an arcuate undersurface that gives the watercraft 10 both lift while in motion and improved turning characteristics. The sponsons are preferably fixed to the surface of the hull 12 and can be attached to the hull by fasteners or molded therewith. Sometimes it may be desirable to adjust the position of the sponson 70 with respect to the hull 12 to change the handling characteristics of the watercraft 10 and accommodate different riding conditions.

As best seen in FIGS. 1 and 2, the helm assembly 60 is positioned forwardly of the seat 28. The helm assembly 60 has a central helm portion 72, that may be padded, and a pair of steering handles 74, also referred to as a handle bar. One of the steering handles 74 is preferably provided with a throttle lever 76, which allows the rider to control the speed of the watercraft 10. As seen in FIG. 2, a display area or cluster 78 is located forwardly of the helm assembly 60. The display cluster 78 can be of any conventional display type, including dials or LED (light emitting diodes). The central helm portion 72 may also have various buttons 80, which could alternatively be in the form of levers or switches, that allow the rider to modify the display data or mode (speed, engine rpm, time . . . ) on the display cluster 78 or to change a condition of the watercraft 10 such as trim (the pitch of the watercraft).

The helm assembly 60 may also be provided with a key receiving post 82, preferably located near a center of the central helm portion 72. The key receiving post 82 is adapted to receive a key (not shown) that starts the watercraft 10. As is known, the key is typically attached to a safety lanyard (not shown). It should be noted that the key receiving post 82 may be placed in any suitable location on the watercraft 10.

Figure 6:
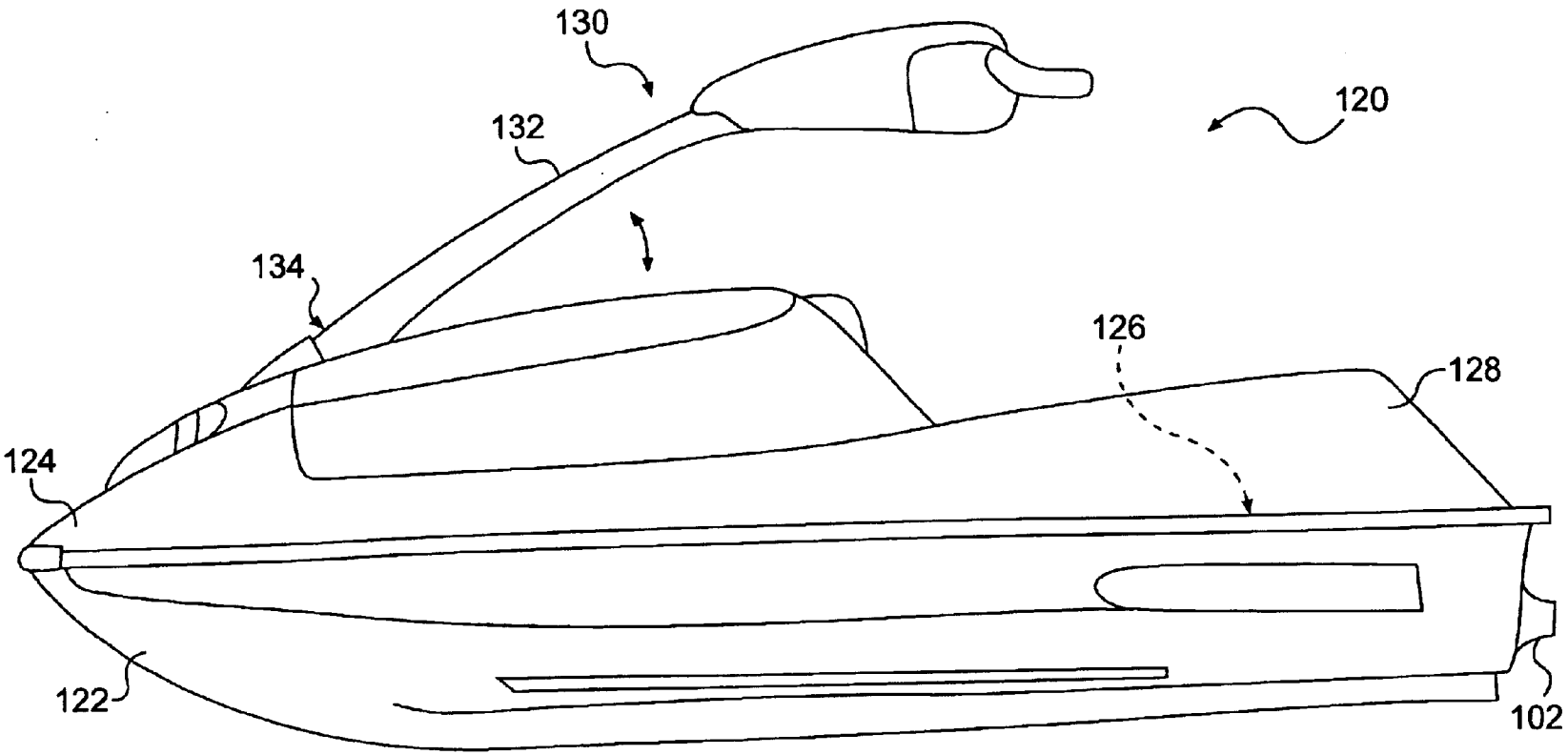
FIG. 6 illustrates an alternative stand-up type watercraft.

Alternatively, this invention can be embodied in a stand-up type personal watercraft 120, as seen in FIG. 6. Stand-up watercraft 120 are often used in racing competitions and are known for high performance characteristics. Typically, such stand-up watercraft 120 has a lower center of gravity and a more concave hull 122. The deck 124 may also have a lower profile. In this watercraft 120, the seat is replaced with a standing platform 126. The operator stands on the platform 126 between the gunnels 128 to operate the watercraft. The steering assembly 130 is configured as a pivoting handle pole 132 that tilts up from a pivot point 134 during operation, as shown in FIG. 6. At rest, the handle pole 132 folds downwardly against the deck 124 toward the standing platform 126. Otherwise, the components and operation of the watercraft 120 are similar to watercraft 10.

Returning to FIGS. 1 and 5, the watercraft 10 is generally propelled by a jet propulsion system that includes a jet pump 200, discussed in greater detail below. As known, the jet pump 200 pressurizes water to create thrust. The water is first scooped from under the hull 12 through an inlet 86, which preferably has a grate (not shown in detail). The inlet grate prevents large rocks, weeds, and other debris from entering the jet propulsion system 200, which may damage the system or negatively affect performance. Water flows from the inlet 86 through a water intake ramp 88. The top portion 90 of the water intake ramp 88 is preferably formed by the hull 12, and a ride shoe (not shown in detail) forms its bottom portion 92. Alternatively, the intake ramp 88 may be a single piece or an insert to which the jet propulsion system 84 attaches. In such cases, the intake ramp 88 and the jet pump 200 are attached as a unit in a recess in the bottom of hull 12.

From the intake ramp 88, water enters the jet pump 200. The jet pump 200 is located in a formation in the hull 12, referred to as the tunnel 94. The tunnel 94 is defined at the front, sides, and top by the hull 12 and is open at the transom 54. The bottom of the tunnel 94 is closed by a ride plate 96. The ride plate 96 creates a surface on which the watercraft 10 rides or planes at high speeds.

Figure 7:
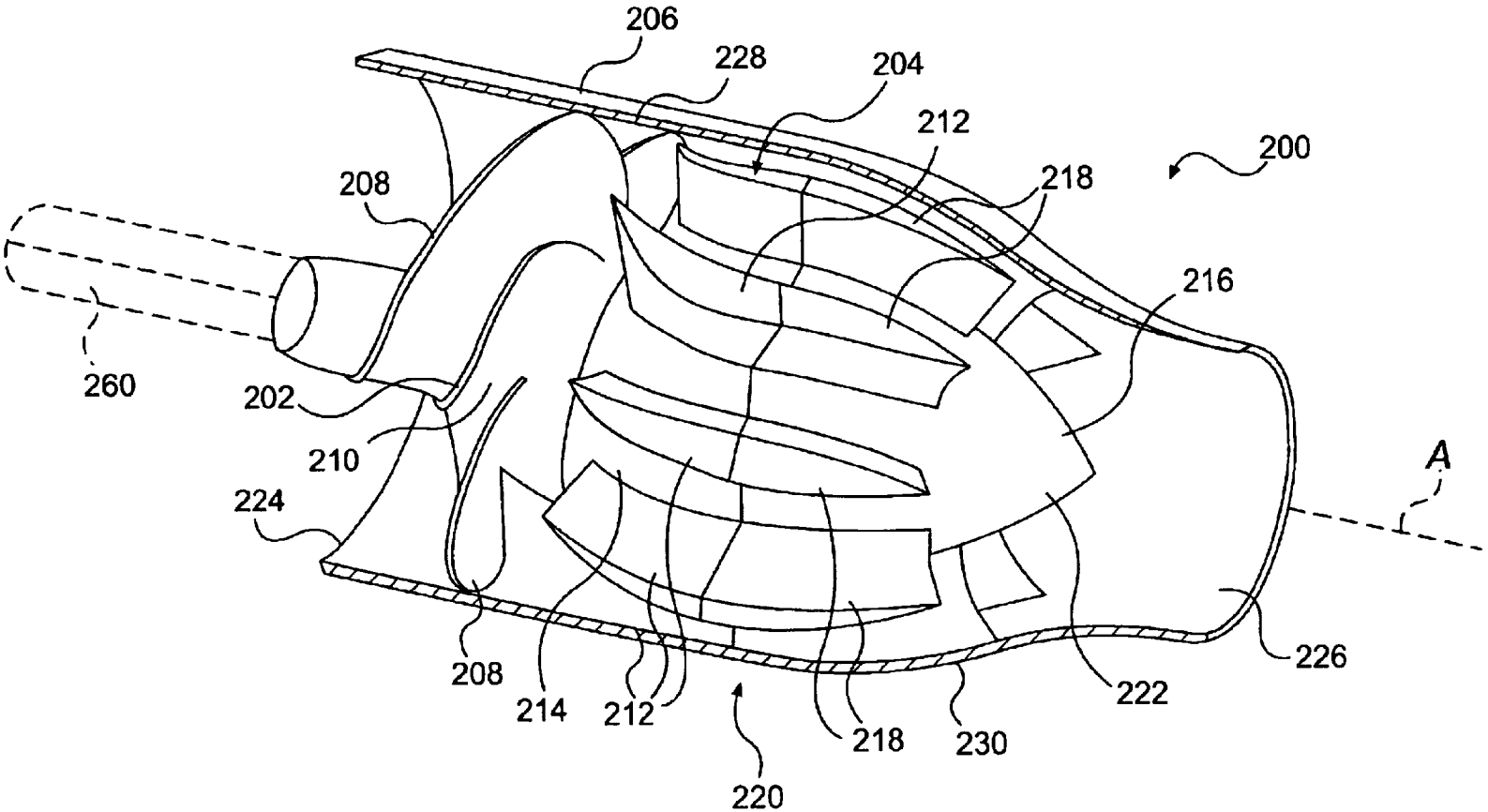
FIG. 7 is a perspective view of a jet pump in partial cross section having stator vanes in accordance with one preferred embodiment of the invention.

As shown in FIG. 7, the jet pump 200 is made of two main parts: an impeller 202 and a stator 204. The impeller 202 is coupled to the engine 22 by one or more shafts 260, such as a driveshaft and/or an impeller shaft. The rotation of the impeller 202 pressurizes the water, which then moves over the stator 204 and the pump cover 216, both of which define a plurality of stator vanes 220. The role of the stator vanes 220 is to decrease the rotational motion of the water so that almost all the energy given to the water is used for thrust, as opposed to swirling the water. Once the water leaves the jet propulsion system 200, it goes through a venturi 230. Since the venturi's exit diameter is smaller than its entrance diameter, the water is accelerated further, thereby providing more thrust. Referring back to FIGS. 1–6, a steering nozzle 102 is pivotally attached to the venturi 230 so as to pivot about a vertical axis 104. The steering nozzle 102 could also be supported at the exit of the tunnel 94 in other ways without a direct connection to the venturi 100.

Figure 8:
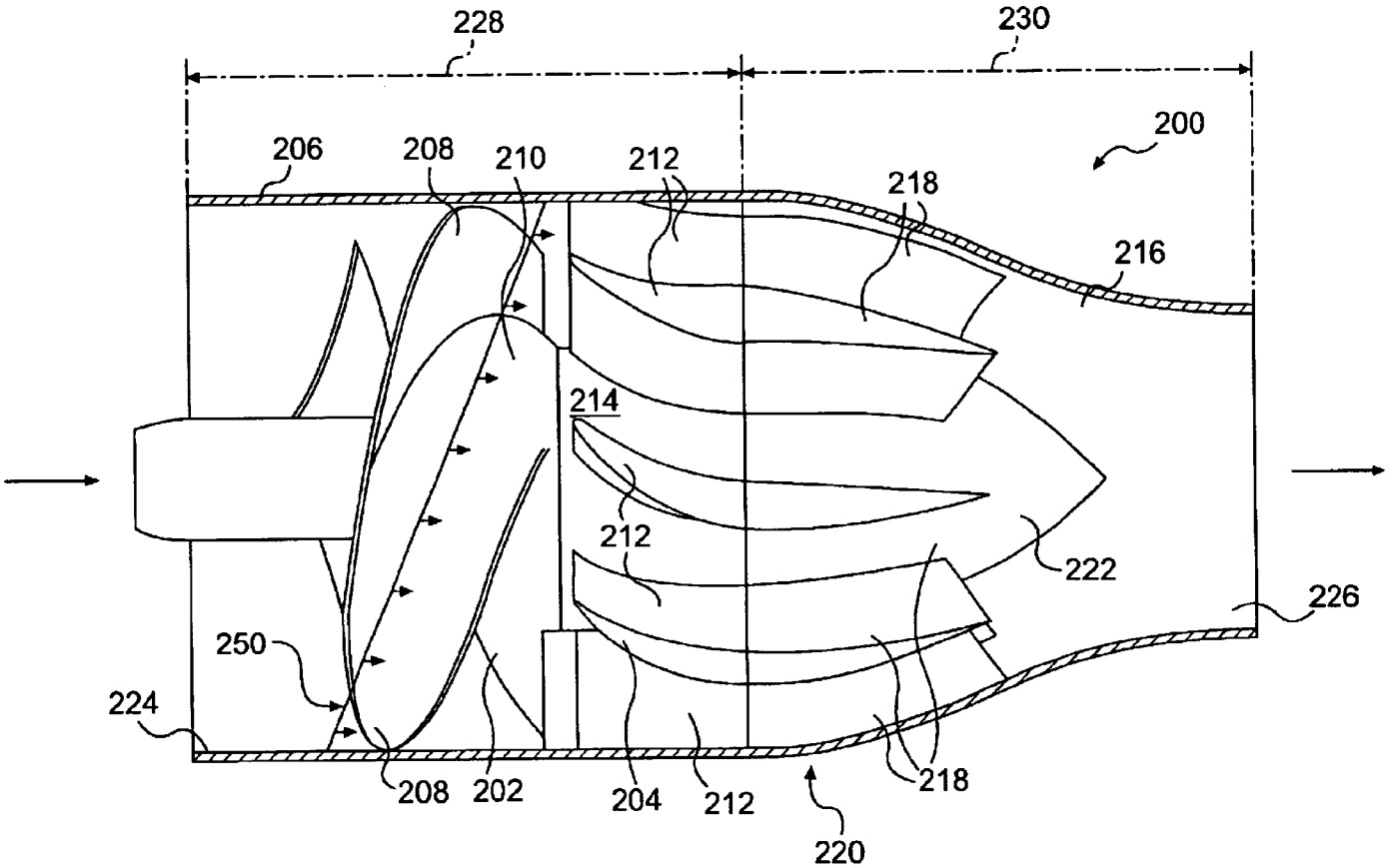
FIG. 8 is a side view in partial cross section of the jet pump shown in FIG. 7.

FIGS. 7 and 8 show one contemplated embodiment of a jet pump 200 embodying principles of the present invention. The jet pump 200 includes a rotatable impeller 202 and a non-rotating stator 204. The impeller 202 and stator 204 are housed within a generally cylindrical housing 206. The housing 206 defines an axial direction of the jet pump 200 along line A. The impeller 202 is rotatably coupled to the stator body 214 via a connecting element and bearings (not shown). It is contemplated that the impeller 202 may be rotatably coupled to the stator 204 with a conventional connecting arrangement, such as that shown in FIG. 14. Of course, any other suitable arrangement may be used.

The impeller 202 includes a plurality of impeller blades 208 extending generally radially outwardly from and circumferentially about an impeller hub 210. The stator 204 includes a plurality of first stator vane portions 212 extending generally radially outwardly from and generally axially along a stator body 214. The stator body 214 is held relatively stationary relative to the housing 206 by the stator vanes 212 extending therebetween and coupled to the housing 206. A pump cover 216 is mounted to the stator body 214 opposite the impeller 202 in any conventional manner, such as with threaded fasteners (not shown). The pump cover 216 includes a plurality of second stator vane portions 218 extending radially outwardly therefrom and generally axially therealong. The first stator vane portions 212 and second stator vane portions 218 abut and cooperate with one another when the pump cover 216 is mounted to the stator body 214 to define a plurality of stator vanes 220. The pump cover 216 includes a generally conical pump cover body 222.

As shown, the housing 206 defines an inlet 224 at an axially forward end thereof and an outlet 226 at an axially rearward end thereof. The housing 206 includes a main body portion 228 within an interior of which is disposed the impeller 202 and at least a portion of the stator 204. The main body portion 228 has a relatively constant cross-sectional configuration and area along an axial extent thereof. Rearward of the main body portion 228, the housing 206 defines a tapered venturi portion 230. The pump cover 216, preferably with a portion of the stator vanes 220, is disposed within the venturi portion 230. As shown, the venturi portion 230 has a decreasing or tapered cross-sectional configuration and area along an axial extent thereof. The housing 206 can be formed as a single piece or a plurality of pieces secured together, either removably or permanently, as by welding.

As shown in FIG. 8, a cross-sectional configuration and area defined by an interior of the housing 206 is relatively constant along the axial extent of the main body portion 228. The cross-sectional configuration and area of the interior of the housing 206, however, decreases along the axial extent of the venturi portion 230. However, an actual or effective cross-sectional area within which water may flow (i.e., flow area) through the jet pump 200 generally decreases along an entire axial extent of thereof. This is effected due to an increase in diameter of the impeller hub 210, which is conically or hemispherically shaped, an increase in volume of the first stator vane portions 212, and the respective tapered diameters of the pump cover 216 and venturi portion 230. A continuous decrease in flow area of the jet pump 200 ensures that a flow of water therein continuously accelerates throughout the axial extent of the jet pump 200, thereby maximizing efficiency of the pump 200.

Figure 9:
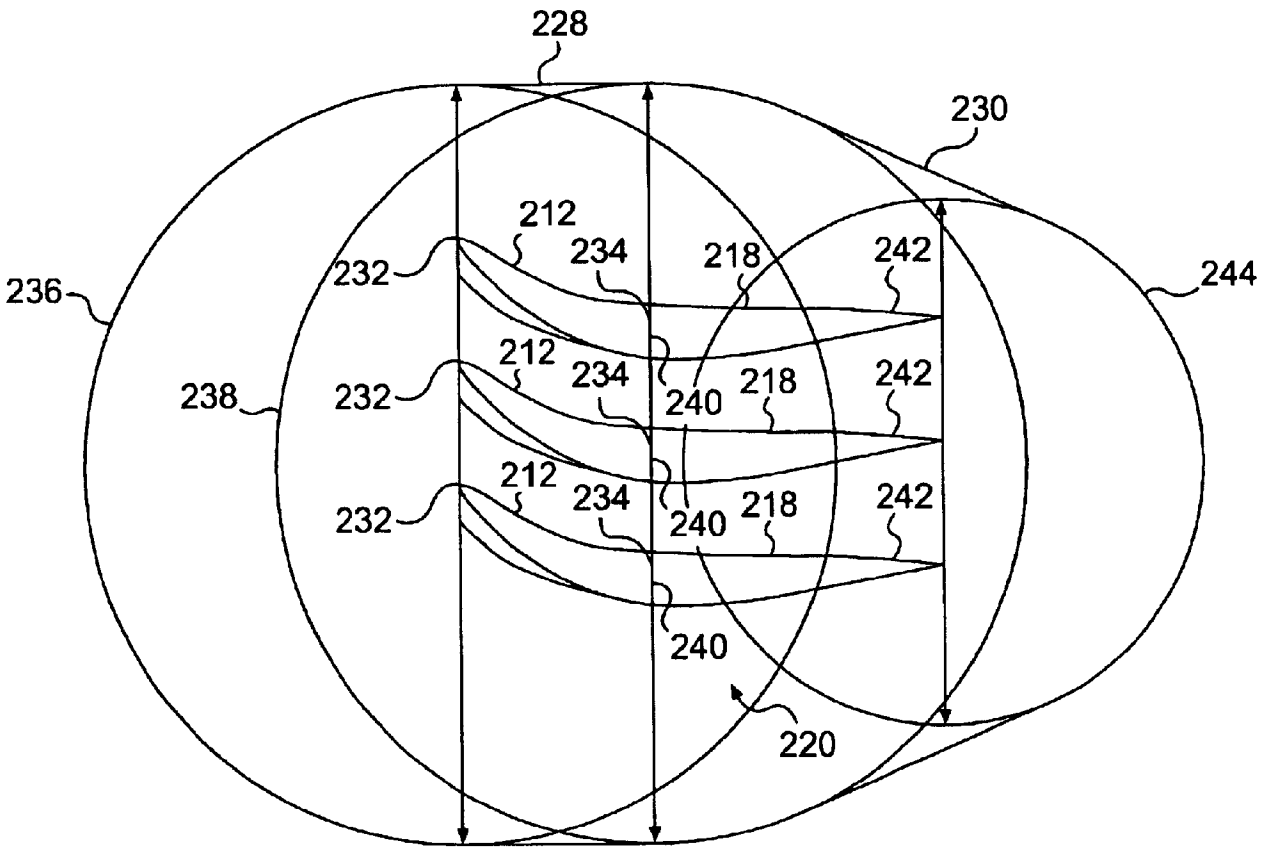
FIG. 9 is a schematic view showing a series of stator vanes of the jet pump shown in FIG. 7 relative to the area of the housing.

As shown in FIG. 9, leading edge portions 232 of the first stator vane portions 212 are relatively narrower than trailing edge portions 234 thereof. The terms leading and trailing herein refer to the direction of water flow wherein the leading edge is the upstream edge and the trailing edge is the downstream edge. Additionally, an interior diameter of the housing 206 at the leading edge portions 232, indicated by circle 236, is relatively equivalent to an interior diameter of the housing 206 corresponding to the trailing edge portion 234, which is indicated at circle 238. Accordingly, a flow area corresponding to these locations progressively decreases along the axial extent of the first vane portions 212, due to the increasing width of the vane portions 212.

Conversely, leading edge portions 240 of the second stator vane portions 218 are relatively wider than trailing edge portions 242 thereof. However, as denoted by circle 244, an internal diameter of the housing 206 gradually decreases along the axial extent of the tapered venturi portion 230. Therefore, even though the area of the second stator vane portions 218 decreases along the axial extent thereof, the overall flow area continues to decrease due to the decrease in the internal diameter of the housing 206. This arrangement ensures continuous acceleration of water flow through the pump 200.

The first stator vane portions 212 and the second stator vane portions 218 connect to form relatively wide stator vanes 220 that have an arcuate airfoil shape, as clearly seen in FIG. 9. Preferably, the stator vanes 220 made of first stator vane portion 212 and second stator vane portion 218 have a thickness of about 2 mm at their outer ends and a central thickness of about 15 mm. This thickness is considerably greater than conventional prior art stator vanes, which typically have a constant thickness of about 2–5 mm. The arrangement of the stator 204 and pump cover 216 may be particularly advantageous, since, combined with the housing 206 having the integral venturi portion 230, water flow is continuously accelerated through the pump 200. Additionally, the stator 204 and pump cover 216 may be relatively easily and cost-effectively manufactured, such as by casting. In particular, since the stator body 214 is generally cylindrical and the vane portions 212 increase in width in the rearward direction, the stator 204 may be cast in a relatively simple and cost-effective manner. Likewise, since both the pump cover body 222 and the second stator vane portions 218 taper in the rearward direction, the pump cover 216 may be cast in a relatively simple manner. The pump cover 216 may then be connected to a rearward end of the stator 204 with, e.g., fasteners, thereby abutting the first and second stator vane portions 212, 218 to define the plurality of stator vanes 220. Furthermore, an effective length of the stator vanes 220 may be increased relative to prior art designs while maintaining ease of manufacture. Moreover, the venturi portion 230 of the housing 206 need not include additional fins or vanes as do the conventional types of jet pumps, which typically do not have pump covers with stator vanes thereon.

Another alternative for the stator vane 220 construction is to make one piece, thickened vanes. This could be accomplished with a complex mold for example. In that case, the vanes could be supported by the stator or by the pump cover.

Referring back to FIG. 8, as the impeller 202 is rotated, each of the blades 208 produces a pressure wave, shown schematically at 250, which consecutively contacts leading edges of the stator vanes 220 in a direction corresponding to a direction of rotation of the impeller 202. At each contact between the pressure wave 250 and the spaced stator vanes 220, a pulse is generated. The frequency of these pulses is based upon the numbers of impeller blades 208 and stator vanes 220, as well as the relative spacings thereof. The level of noise generated by the pump 200 depends on the frequency and amplitude of the pulses.

In prior art pump designs, as discussed previously, large noise levels are generated at a critical frequency, due to the rotor-stator interaction. As shown by the graphical representation of the noise level in FIG. 11, the solid line represents a prior art jet pump that produces a significantly large noise level ($dB_{max}$) when operated at the critical frequency (cf) due to the constructive interference of the pulses. Subsequent harmonics (cfh1–cfh4) of the critical frequency also generate a large noise level. Although shown as having a constantly decreasing noise level in FIG. 11, it should be noted that this is only an example, $dB_{max}$ could occur at any subsequent harmonics, and any harmonics could have a higher or lower noise level than the preceding harmonics.

Figure 10:
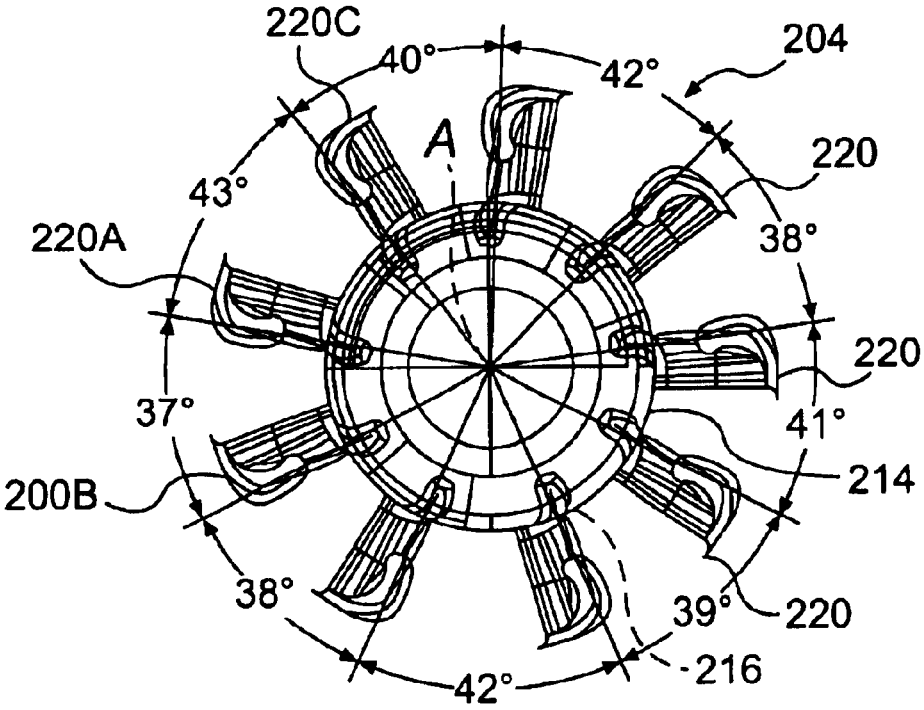
FIG. 10 is a front view of a stator illustrating the non-uniform spacing of the stator vanes in accordance with another preferred embodiment of the invention.

FIG. 10 shows a contemplated arrangement of stator blades 220 according to another feature of the invention. As shown in this arrangement, the stator blades 220 may be non-uniformly spaced about the stator body 214 and pump cover 216. For example, spacing between a pair of stator vanes 220A, 220B (shown as 37°) is different than spacing between an adjacent pair of vanes 220A, 220C (shown as 43°). Additionally, the vanes 220 may be arranged such that diametrically opposed vanes do not align with one another. More particularly, the stator vanes 220 are preferably spaced such that at least one trailing edge of the plurality of impeller blades 208 is circumferentially offset from the leading edge of any of the stator vanes 220 for any relative rotational position of the impeller 202 and stator 204. A substantial noise reduction may be obtained with an arrangement of stator vanes 220 in which only one trailing edge of the total number of impeller blades 208 is circumferentially offset from the stator vanes 220. However, it may be preferable for the arrangement of stator vanes 220 to allow for only one trailing edge of the impeller blades 208 to align with the leading edge of a stator vane 220 for any relative rotational position of the impeller 202 and stator 204. For example, a noise reduction may be obtained with a three-bladed impeller by arranging the stator vanes 220 such that only two trailing edges of the impeller blades may align with the leading edges of stator vanes 220 at any one time. However, a greater noise reduction may be obtained if the stator vanes 220 are arranged such that only one trailing edge of the impeller blades may align with a leading edge of the stator vanes 220 at any one time. The actual arrangement of the stator vanes 220 will depend on which critical frequency/frequencies need to be addressed.

Figure 10A:
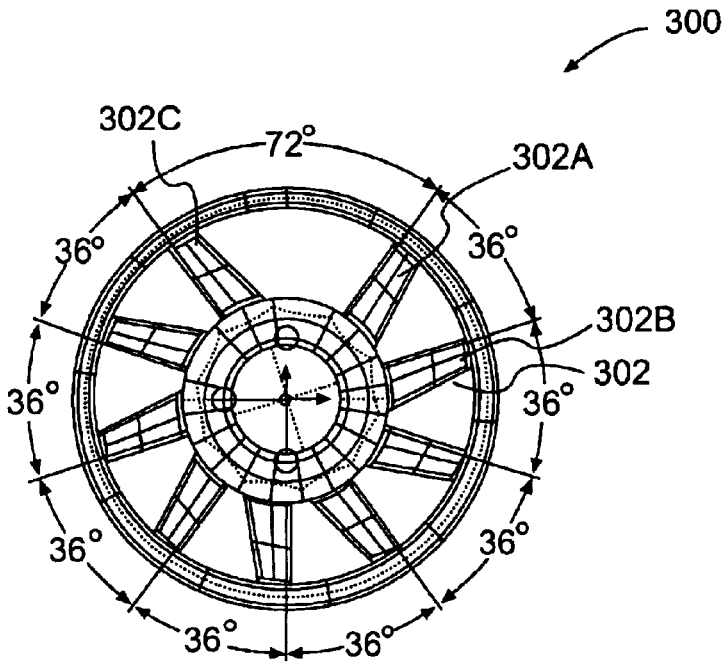
FIG. 10A is a front schematic view of another stator in accordance with the invention with non-uniform spacing between vanes.
Figure 10B:
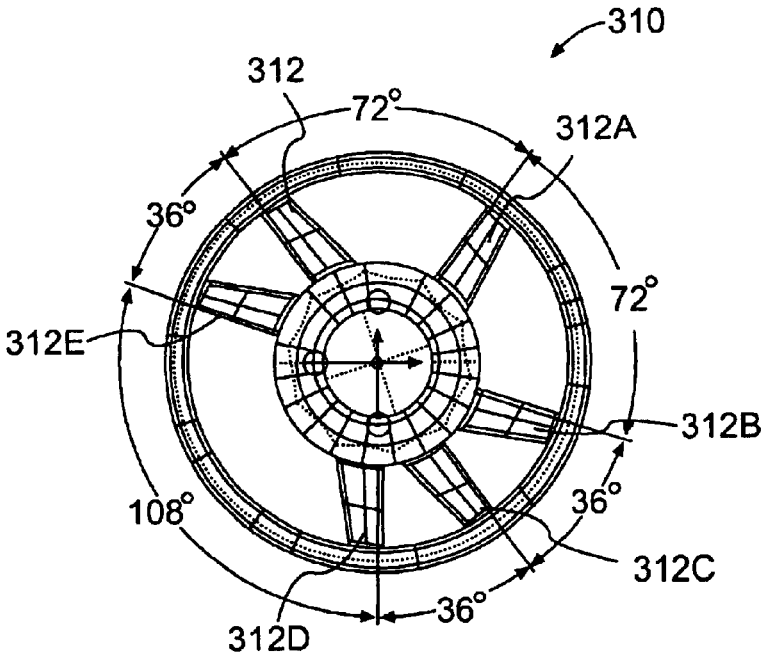
FIG. 10B is a front schematic view of another stator in accordance with the invention with non-uniform spacing between vanes.
Figure 17:
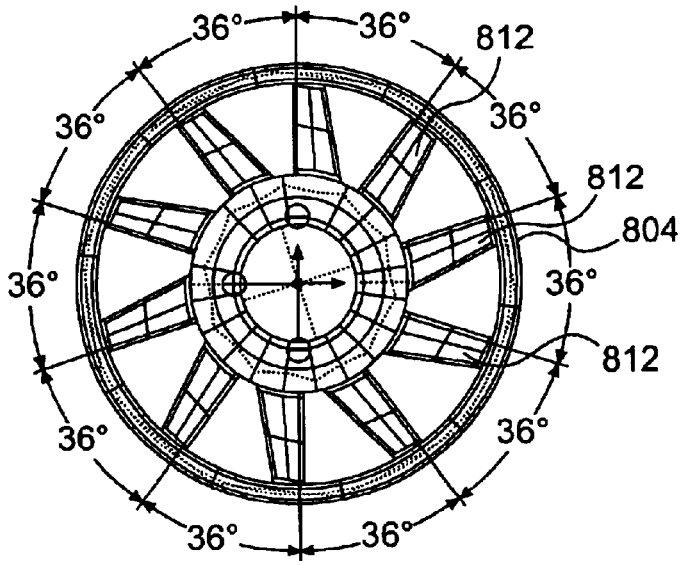
FIG. 17 PRIOR ART
FIG. 17 is a front schematic view of a prior art stator.
Figure 18:
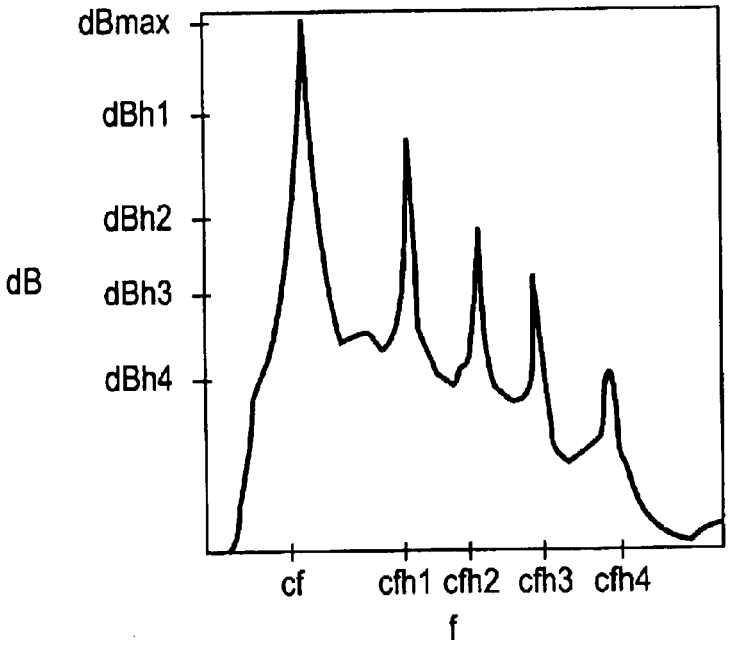
FIG. 18 PRIOR ART
FIG. 18 is a graphical representation of noise levels generated by a prior art jet pump having the stator of FIG. 17.

A similar result can be achieved by redesigning a conventional stator having evenly spaced stator vanes, such as stator 804 of FIG. 17, and removing one or more stator vanes. FIG. 10A shows a stator 300 with stator vanes 302 that are spaced unevenly apart, with effectively one vane removed. As seen, stator vane 302A and stator vane 302B, for example, are spaced approximately 36° apart, while stator vane 302A and stator vane 302C are spaced approximately 72° apart. FIG. 10B shows a similar stator 310 with four vanes 312 effectively missing. In this case, stator vanes 312A and 312B are approximately 72° apart, stator vanes 312B, 312C and 312D are approximately 36° apart, and stator vanes 312D and 312E are approximately 108° apart, as seen. Of course other arrangements and configurations can be employed while still remaining within the scope of this concept.

Figure 10C:
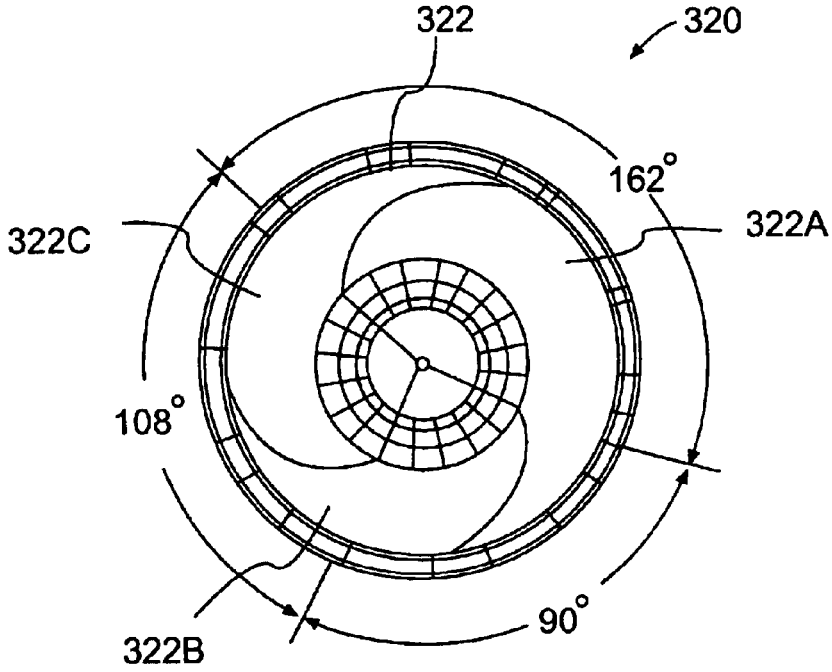
FIG. 10C is a front schematic view an impeller in accordance with an embodiment of the invention showing non-uniform spacing between impeller blades.

FIG. 10C shows another variation of the concept of uneven spacing in which the impeller 320 has unevenly spaced impeller blades 322. As seen, the edge of impeller blade 322A is offset from the edge of impeller blade 322B by approximately 162°, the edge of impeller blade 322B is offset from the edge of impeller blade 322C by approximately 90°, and the edge of impeller blade 322C is offset from the edge of impeller blade 322A by approximately 108°. The uneven spacing of the impeller blades 322 achieves a similar effect as the unevenly spaced stator vanes by staggering pressure waves and subsequent pulses to eliminate interference.

Figure 11:
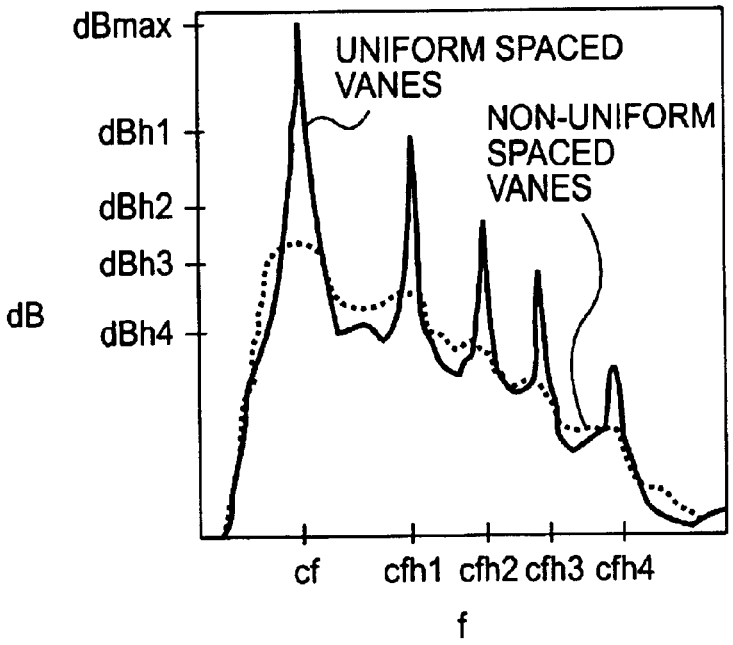
FIG. 11 is a graphical representation of noise levels generated by a jet pump having the stator shown in FIG. 10 relative to prior art jet pumps.

As shown by the dotted line in the graph of FIG. 11, a stator having stator vanes that are unevenly spaced such that any number of trailing edges of impeller blades less than the total number of impeller blades provided on the impeller passes over a stator vane at any one time. Accordingly, the pressure waves and subsequent pulses are staggered and, therefore, cannot constructively interfere with one another. This way, the noise level, especially at the critical frequency and its harmonics, remains substantially lower than with prior art uniformly spaced vanes due to a lower amplitude of tones produced by the blade pass frequency and the more even amplitude distribution.

Figure 14:
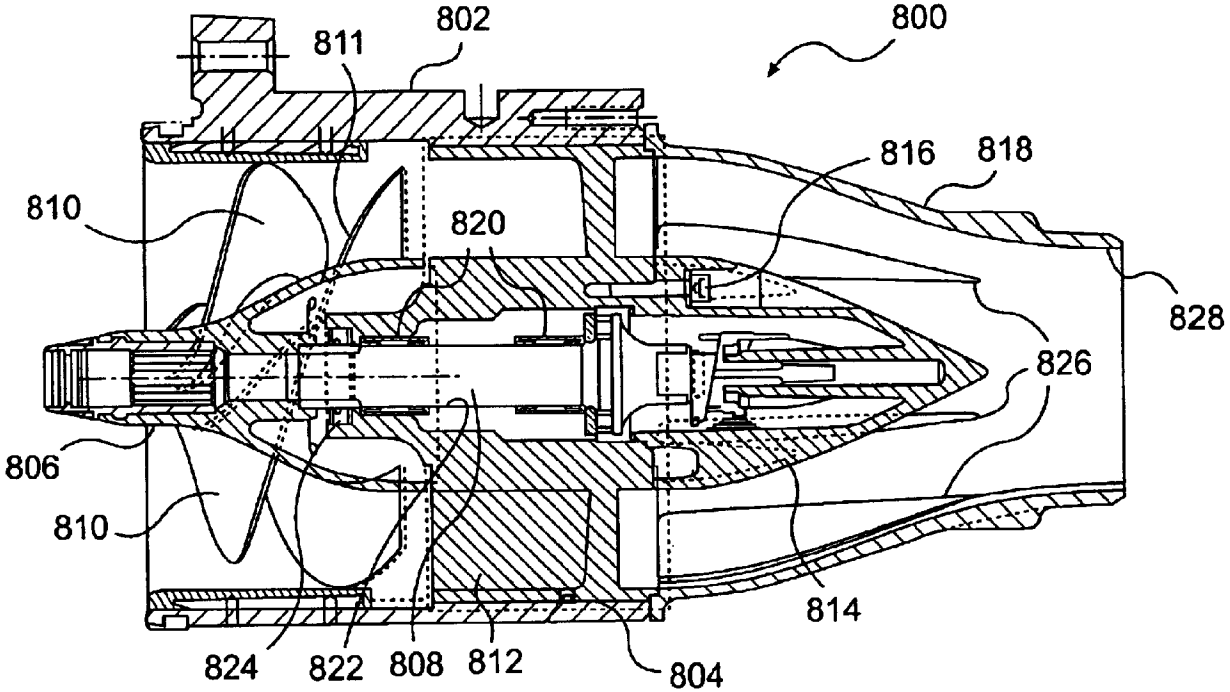
FIG. 14 PRIOR ART
FIG. 14 is a side view in cross section of a prior art jet pump.
Figure 15:
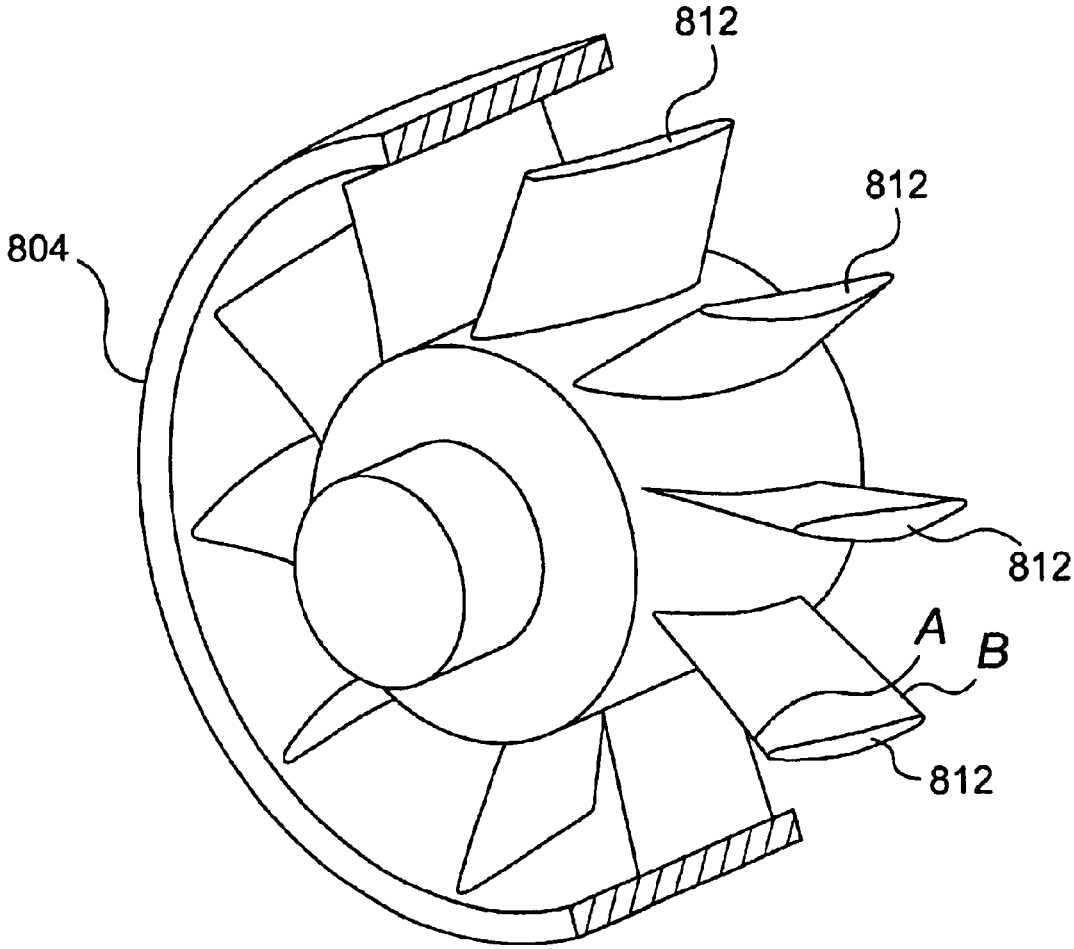
FIG. 15 PRIOR ART
FIG. 15 is a partial perspective view of an impeller of the jet pump shown in FIG. 14.
Figure 16:
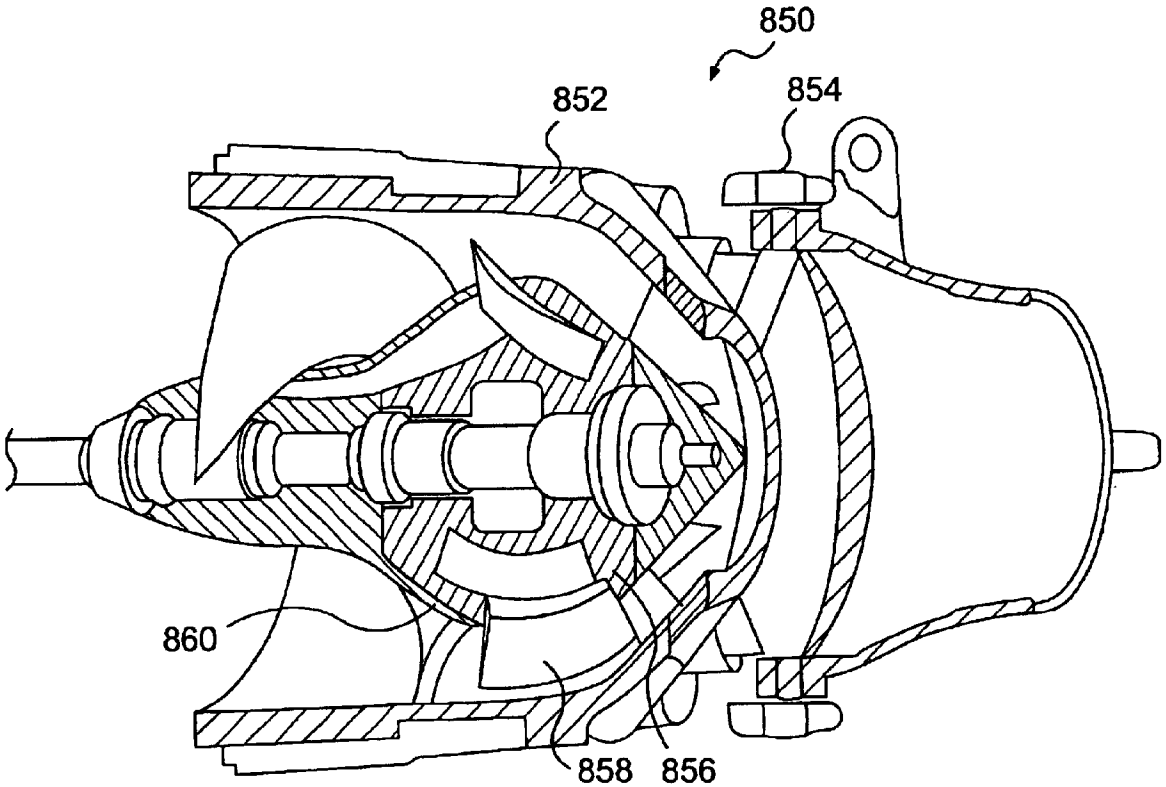
FIG. 16 PRIOR ART
FIG. 16 is a side view in partial cross section of another prior art jet pump.

The unevenly spaced arrangement of stator vanes may be implemented using the thick stator vanes 220 described above, or with conventional stator vanes, as shown in FIGS. 14–16.

Figure 12:
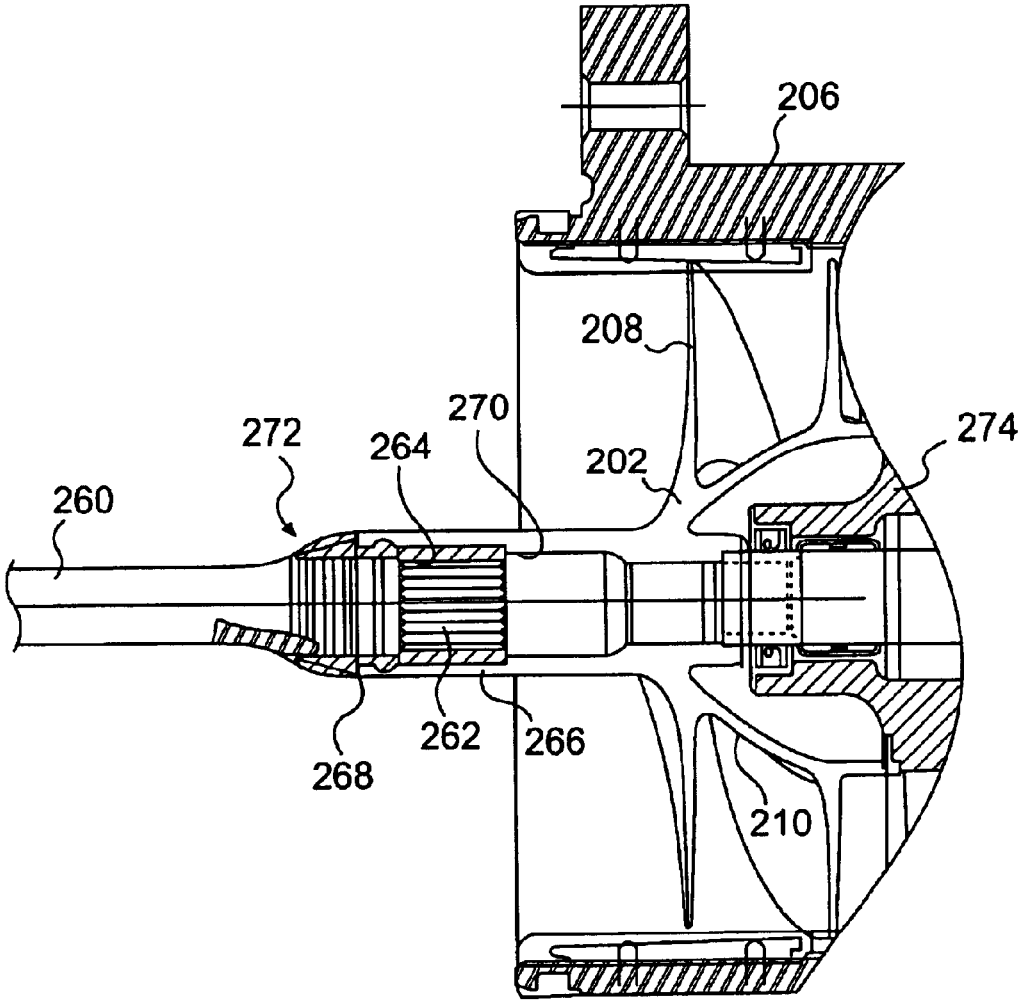
FIG. 12 is a partial cross-sectional view of a jet pump having a coupling structure between the impeller and drive shaft in accordance with another preferred embodiment of the invention.

In accordance with a third feature of the invention, FIG. 12 shows a drive shaft or an impeller shaft 260 coupled to the impeller 202. The drive shaft 260 may be connected directly to the engine 22 or may be coupled to the engine 22 with one or more other shafts. A confronting end of the shaft 260 defines a splined connecting portion 262 that engages within a splined socket 264 provided within a coupling structure 266 of the impeller 202. While the coupling structure 266 is shown integrally formed with the impeller 202, it is contemplated that the coupling structure 266 may be separate and joined with the impeller 202 with, e.g., fasteners, welding, etc. The coupling structure 266 extends axially forwardly from the impeller hub 210 and provides the socket 264 with a mouth in a forward end portion 268 thereof. The coupling structure 266 provides a splined connecting portion receiving space or bore 270 therein between the socket 264 and the impeller hub 210. An inner diameter of the bore 270 is relatively greater than that of the socket 264. More specifically, the inner diameter of the bore 270 is sufficiently large to allow the splined connecting portion 262 to be received therein. A sealing structure 272 may be provided between the shaft 260 and coupling structure 266 to prevent water and debris from entering between the splined portion 262 and socket 264. Of course, the shaft 260 can be attached by any known method that permits rotation, such as a keyed coupling formation.

During operation, the torque transferred from the shaft 260 to the impeller 202 creates an axial thrust component that is transferred to the pump bearings, such as bearings 274. In the event of a failure of the bearings, if the axial thrust is sufficiently large, the coupling structure 266 moves axially relative to the shaft 260 such that an entire axial extent of the splined portion 262 can be received within the bore 270, which has an axial extent at least equal to that of the splined portion 262. Once the splined portion 262 is entirely received within the bore 270, splined engagement between the splined portion 262 and socket 264 is released, thereby allowing relative rotational movement between the shaft 260 and impeller 202, and eliminating the transfer of torque from the shaft 260 to the impeller 202. Since no more torque is transferred to the impeller, the axial thrust component is also eliminated. This prevents the undesirable transfer of axial thrust to the engine. Furthermore, the axial extent of the bore 270 should be sufficient to allow for a maximum axial displacement of the impeller 202 during failure of the jet pump 200. Accordingly, the impeller 202 does not transfer the axial thrust to the engine via the shaft 260 when failure occurs. This spacing feature differs from conventional prior art designs, such as shown in FIG. 14, in which the splined correction is disposed directly adjacent to the impeller hub.

It is contemplated that the coupling structure 266, rather than being connected to the impeller 202, may be connected between the engine and the output shaft thereof to effect the same function as described above. Any known coupling structure could be used, especially those known to accommodate rotational movement.

Figure 13:
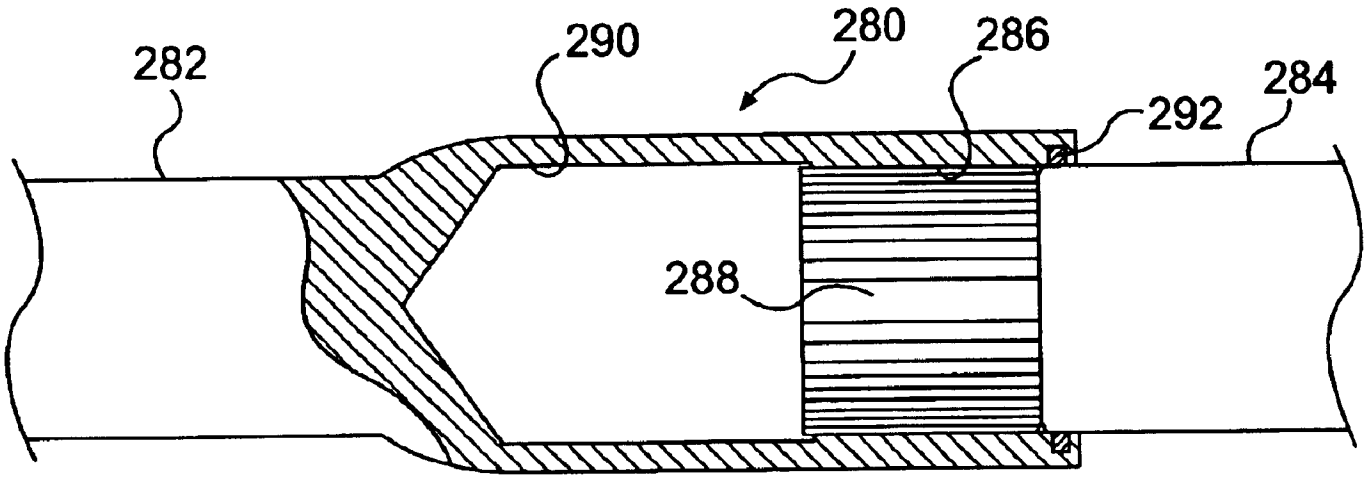
FIG. 13 is an enlarged partial cross-sectional view of a coupling structure between two interconnected drive shafts in accordance with another embodiment of the present invention.

It is also contemplated that a similar concept may be applied to a coupling structure, such as that shown at 280 in FIG. 13, between multiple drive shafts of a PWC connecting the engine and jet pump. As shown, a pair of shafts 282, 284 is provided, one having the coupling structure 280 on a confronting end thereof. It is contemplated that the coupling structure 280 may be integrally formed with one of the shafts 282, 284 or may be separate and connected thereto with, e.g., fasteners, welding, etc. The coupling 280 includes a splined socket 286, with a mouth that receives a splined end portion 288 of the opposite shaft therein. The coupling 280 also includes a splined end portion receiving space or bore 290 between the socket 286 and shaft 282. A seal structure 292 may be provided to prevent water and debris from entering the socket 286. As described previously, when an axial thrust imparted by pump failure axially moves one of the shafts relative to the other, the splined end portion 288 is received within the bore 290. Sufficient axial displacement of the shafts 282, 284 will disengage the splined end portion 288 from the socket 286 to allow relative rotation therebetween, thereby eliminating the transfer of torque between shafts 282, 284, and therefore the axial thrust. This prevents the undesirable transfer of axial thrust to the engine.

The coupling structures 266, 280, described herein, can be used in combination with the impeller assembly described above or with any type of conventional impeller construction. It would even be possible to employ such a spaced coupling structure in a propeller driven system, particularly between the propeller and the drive shaft.

Although the above description contains specific examples of the present invention, these should not be construed as limiting the scope of the invention but as merely providing illustrations of some of the presently preferred embodiments of this invention. Thus, the scope of the invention should be determined by the appended claims and their legal equivalents rather than by the examples given.

Additionally, as noted previously, this invention is not limited to PWC. For example, the stator vane and impeller-drive shaft arrangements disclosed herein may also be useful in jet powered outboard engines, sport boats or other floatation devices other than those defined as personal watercrafts, or any impeller driven device.

What is claimed is:

1. A jet pump for a watercraft comprising:

a generally cylindrical housing having a forward portion and a rearward portion thereof;

an impeller having a plurality of impeller blades mounted thereon, said impeller being disposed within said forward portion of said housing and being configured to be connected to a rotatable shaft so as to be rotatable within said housing;

a stator fixedly mounted within said housing adjacent to and rearward of said impeller, said stator having a plurality of circumferentially spaced first vane structures extending generally radially outwardly therefrom, extending axially along said stator, and tapered in width axially toward said impeller;

a pump cover being fixedly mounted to a rearward side of said stator and having a plurality of circumferentially spaced second vane structures extending generally radially outwardly therefrom, extending axially along said pump cover, and tapered in width opposite said first vane structures, wherein each of said plurality of first vane structures abuts a respective one of said plurality of second vane structures, said pluralities of abutting first and second vane structures defining a plurality of stator vanes extending axially along said stator and said pump cover and being positioned rearward of said impeller.

2. A jet pump as in claim 1, wherein each of said stator vanes has a forward portion thereof tapered in width towards said impeller, an intermediate portion thereof having a substantially constant width, and a rearward portion thereof tapered in width opposite said forward portion.

3. A jet pump as in claim 1, wherein said rearward portion of said housing defines a venturi portion that provides an outlet opening for the jet pump at rearward end thereof and has a tapering cross-sectional area toward the outlet opening.

4. A jet pump as in claim 1, wherein said pump cover has a tapering cross-sectional area toward the outlet opening.

5. A jet pump as in claim 1, in combination with a watercraft comprising:

a hull having port an starboard sides and a stern;

a deck mounted on said hull;

an operator support mounted on the deck;

a helm supported by said deck forward of the operator support including a steering handle and a throttle controller;

an engine mounted on the hull having a drive shaft; and wherein the jet pump is supported by said hull, and the drive shaft is drivingly connected to the impeller.

* * * * *